US006517042B1

(12) United States Patent
Mlakar et al.

(10) Patent No.: US 6,517,042 B1
(45) Date of Patent: Feb. 11, 2003

(54) STAND FOR VERTICALLY RECEIVING ROD-SHAPED MATERIALS

(76) Inventors: Erika Mlakar, Am Steinig 25, 63863 Eschau (DE); Günter Mlakar, Am Steinig 25, D-63863 Eschau (DE)

( * ) Notice: Subject to any disclaimer, the term of this patent is extended or adjusted under 35 U.S.C. 154(b) by 0 days.

(21) Appl. No.: 09/889,763

(22) PCT Filed: Feb. 19, 1999

(86) PCT No.: PCT/DE99/00475

§ 371 (c)(1),
(2), (4) Date: Jul. 19, 2001

(87) PCT Pub. No.: WO00/48492

PCT Pub. Date: Aug. 24, 2000

(51) Int. Cl.[7] ..... F16M 13/00

(52) U.S. Cl. ..... 248/523; 248/172; 248/230.2; 248/316.2

(58) Field of Search ..... 248/523, 518, 248/519, 524, 525, 172, 230.1, 230.2, 230.3, 316.1, 316.2, 316.4; 47/40.5, 42

(56) References Cited

U.S. PATENT DOCUMENTS 2,639,877 A * 5/1953 Fox ..... 248/523
2,896,293 A * 7/1959 Love ..... 248/523
4,515,195 A * 5/1985 Gladstein ..... 248/172 X
5,375,808 A * 12/1994 Roy ..... 248/523
5,685,518 A * 11/1997 Fox et al. ..... 248/523
6,012,698 A * 1/2000 Hardt et al. ..... 248/523

FOREIGN PATENT DOCUMENTS

DE 29700978 * 5/1997
DE 36 32 693 A1 3/1998

* cited by examiner

*Primary Examiner*—Leslie A. Braun
*Assistant Examiner*—Tan Le
(74) *Attorney, Agent, or Firm*—Edwin D. Schindler

(57) ABSTRACT

The invention relates to a stand for vertically receiving rod-shaped materials, comprising a base plate (1) that has two diametrically opposite clamping jaws (2) which are disposed on a substantially horizontal plane and are used for receiving a rod. At least one (2.2) of said jaws can be displaced radially in an outward direction counter to the force of a spring (5). Said displaceable clamping jaw (2.2) is pivotally connected to one end of a lever (6), whereby the opposite end thereof is guided and displaced in a substantially vertical manner and is located above the horizontal plane defined by the direction of movement of the clamping jaw (2.2).

9 Claims, 1 Drawing Sheet

STAND FOR VERTICALLY RECEIVING ROD-SHAPED MATERIALS

BACKGROUND OF THE INVENTION

Technical Field of the Invention

Figure 1:
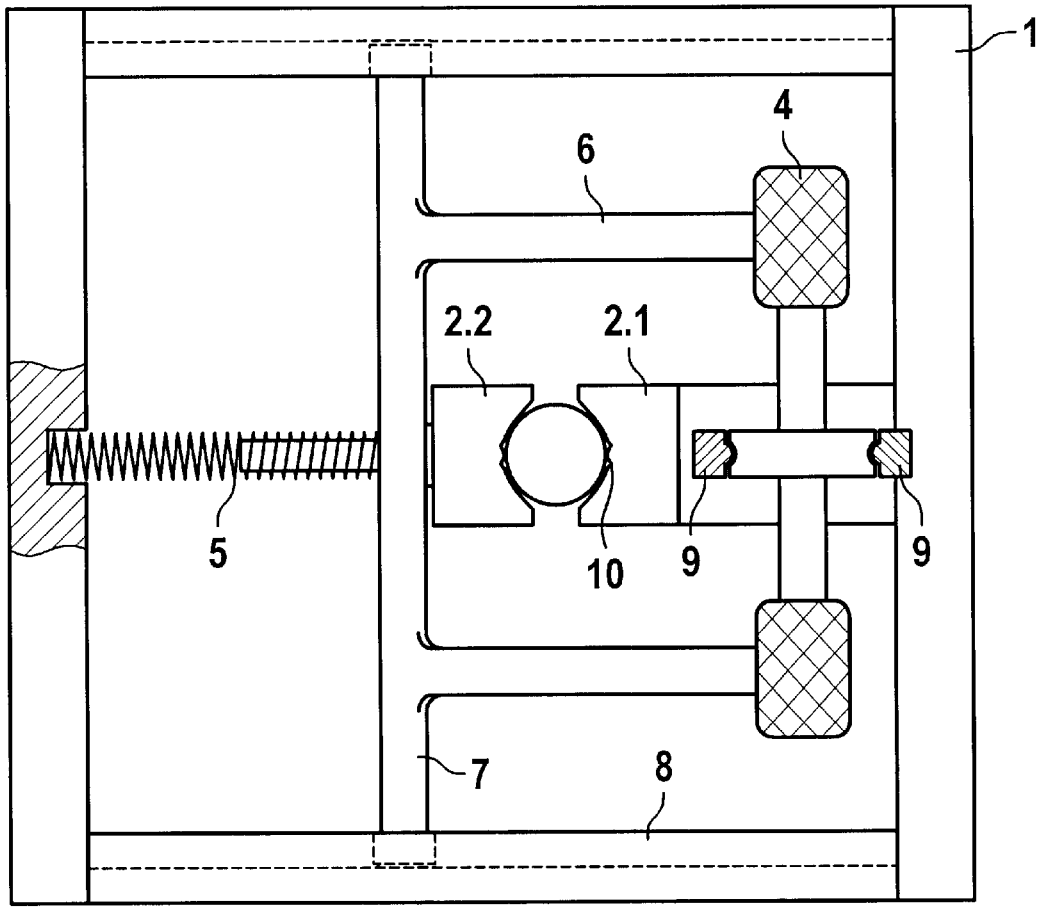

The invention relates to a stand for vertically receiving rod-shaped materials, comprising a base plate that has at least two diametrically opposed clamping jaws which are disposed on a substantially horizontal plane and are used for receiving a rod. At least one of said jaws can be displaced radially in an outward direction counter to the force of a spring.

Description of the Prior Art

A device of this generic concept is known from DE-A-36 23 693, which discloses at least two diametrically opposed clamping jaws that grasp the vertical rod, for example, a Christmas tree or a flagpole, whereby at least one of the clamping jaws is spring-loaded and can be displaced radially in an outward direction. As far as practical handling is concerned, it proves difficult to open the displaceable clamping jaw counter to the force of the spring by hand and, at the same time, using the other hand, to introduce the rod between the opened clamping jaws, especially if the object is a flagpole, a Christmas tree or a larger mast. The help of a second person is usually required, who—after the first person has opened the clamping jaws—positions the rod or the Christmas tree between the clamping jaws.

SUMMARY OF THE INVENTION

On this basis, the invention has the object of providing a stand which can be used effortlessly by a single person and which brings a rod into a secure vertical position and fixes it there.

In accordance with the invention, this task is solved therein that the displaceable clamping jaw is pivotally connected to one end of a lever, whereby the opposite end thereof is guided and displaced in an abutment in a substantially vertical manner and is located above the horizontal plane defined by the direction of movement of the clamping jaw.

The invention's central idea consists therein to displace the clamping jaw to be actuated for opening via a lever, which is disposed in a special way and manner and is guided displaceably in an abutment. Here, the lever, most simply conceivable as a straight bar, is pivotally connected directly or indirectly to the displaceable clamping jaw, whereby the opposite end of the lever is guided in an abutment that facilitates substantially vertical displacement. The arrangement of the different possible positions of the end of the lever in the abutment is to be effected so that said end is located above the horizontal plane defined by the direction of movement of the clamping jaw during every phase of motion. Consequently, a downward movement of the end guided in the abutment presses the clamping jaw away from the abutment, thereby opening the stand or releasing the rod. Within the meaning of the invention, the term 'vertically displaceable' denotes that the abutment may comprise a strictly vertical guidance, but also a guidance with a specific inclination in relation to the perpendicular. The displacement of the end of the lever within the abutment can also be achieved by a downward movement of the foot, that is, the operator steps on the end of the lever, whereby both hands are free to insert or remove the rod from the clamping jaws.

To realise the inventive idea, it is sufficient to employ two clamping jaws, one of which is displaceable. Moreover, a larger number of clamping jaws can be provided, whereby one or also several are disposed displaceably and displaced synchronously.

As regards the use of the application force produced by the springs, it is optimum if rigid and displaceable clamping jaws are disposed diametrically opposite each other. The application force is fully compensated by the rigid, opposing clamping jaw in the sense of a bearing. One then obtains a optimum relationship of forces for configuring the clamping jaws.

In an advantageous embodiment, the lever is configured like a frame, whereby one lateral length corresponds to the end of the lever connected pivotally to the displaceable clamping jaw and the opposing lateral length produces the connection to the abutment. The parts of the frame located in between, which extend essentially perpendicularly thereto, give a closed form that circumscribes the reception of the rod.

To improve the guidance, and for lateral support, in a further embodiment, the lever (or also the frame) is guided on both sides in the region of the swivelling axis in a guiding groove in the base plate by a cross brace, which is aligned in the direction of movement of the clamping jaw. Although further possibilities for guiding the displaceable clamping jaw are conceivable, this comprises a preferred option because it provides an optimum manner of support.

The constructional, concrete form of the abutment is configured as an essentially vertically aligned inclination, along which the end of the lever slides. By means of the force of the spring upon the displaceable clamping jaw, and the opposite end of the lever connected thereto, the end of the lever on the abutment side is pressed against the inclination. When a downward movement occurs, the opposite clamping jaw is pressed away from the abutment, whereby the downward movement can be achieved by stepping thereupon. To achieve the best transmission of forces, with as little friction as possible, the end of the lever rests against the inclination via a roller so that a loss of force is minimised by means of rolling friction.

To facilitate the downward movement of the lever in the region of the abutment, a tread surface is disposed there, upon which one can step and thus the downward movement of the lever can be effected comfortably by means of application of force, that is, by moving one's foot downward or through the operator's weight.

To make it possible to place both feet thereupon, and to enable the application of one's total weight while avoiding overturning moments, it is proposed to configure two tread surfaces symmetrically in relation to the abutment.

For utilising the inventive stand, the shape of the rod cross section is basically optional. To produce optimum, that is, large-surface contact between the rod and the clamping jaws, it is advantageous to select the interior shape of the clamping jaws so that it is commensurate with the shape of the cross section of the rod to be inserted. In the case of a round rod, clamping jaws that have a circular form with the corresponding radius are especially used. This embodiment is also recommended if the material used for the rod is sensitive and should be largely free of pressure marks.

With other materials, the option is given to select a rhombus shape for the closed clamping jaws. Then, the contact between the clamping jaw and the rod does not have to be produced across the whole circumference so that this shape proves advisable especially if the shape of the rod cross section is irregular.

If soft materials are used, support and force transmission can be improved by integrating a spike inside the clamping jaws, that is, on the side facing the rod. When the clamping jaws are closed, the spike digs into soft materials, for example, wood, and in this way establishes intimate contact.

BRIEF DESCRIPTION OF THE DRAWING FIGURES

Further details, features, and the advantageous constructive solution provided by the present invention can be taken from the following description in which a typical embodiment of the invention is shown using a drawing.

Figure 2:
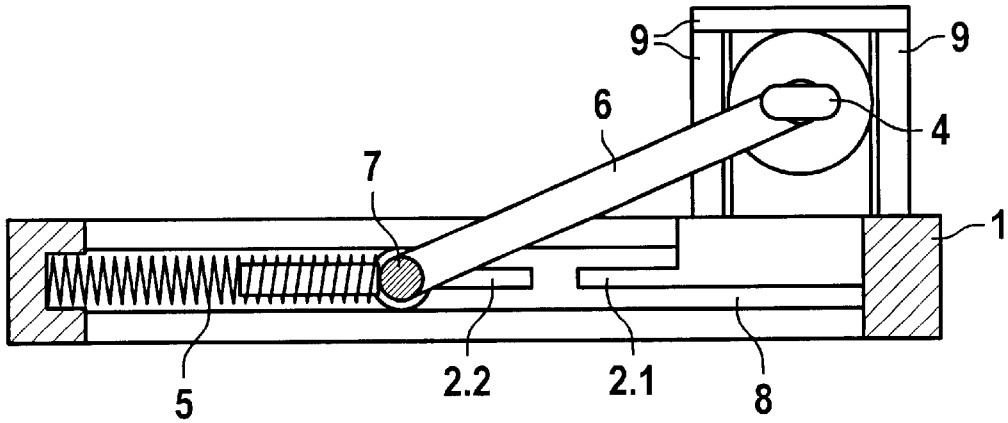

It shows:

FIG. 1 a top plan view of the inventive stand,

FIG. 2 a front view of the stand according to FIG. 1.

DETAILED DESCRIPTION OF THE DRAWING FIGURES AND PREFERRED EMBODIMENTS

In accordance with FIG. 1, the whole stand is disposed on a preferably square base plate (1) whose height depends on the rod to be supported. In accordance with its lining, said base plate (1) can be filled usually with sand, earth or water. If a person steps with both feet upon the parallel tread surfaces (4) of the lever (6), further tension is applied to the already prestressed spring (5). This is effected in that the rigid lever (6) extending from the tread surfaces (4), which are displaced downward, pushes together the cross brace (7) and the centrally disposed spring (5) so that the displaceable clamping jaw (2.2) of the clamping jaws (2) opens in the direction of the spring (5) and applies further tension to the same. When the tread surface (4) of the lever (6) is released, the tensioned spring (5) returns to the original position, and thereby also pushes back the cross brace (7). Thus, the displaceable clamping jaw (2.2) of the clamping jaws (2) closes again. To prevent the cross brace (7) from tilting in the vertical direction, owing to possibly uneven application upon the tread surfaces (4) of the lever (6), said cross brace (7), for reasons of stability, is embedded in guiding grooves (8), extending parallel to the lever (6) and the clamping jaw (2), preferably below the edge of the exterior frame of the housing (1). Additional stability, the defined downward movement of the tread surfaces (4) per se and the push together as far as beyond the spring (5) is achieved via an abutment (9) which is disposed centrically between the two tread surfaces (4). The clamping jaws (2) show a preferred shape with respectively one spike (10) integrated in the direction of action in order to hold woody rods securely and with more stability in the clamping jaws (2).

For better recognition, FIG. 2 represents a side view of the same stand for vertically receiving different rod-shaped materials. This is to improve recognition of the interaction between the abutment (9), the two tread surfaces (4) with the rigid lever (6), and the cross brace (7) with its guiding groove (8) in the exterior of the housing (1) and the spring (5).

What is claimed is:

1. A stand for vertically receiving rod-shaped materials, comprising:

a spring for providing a biassing force against a rod;

a lever having a first end and a second end with said first end being an opposite end relative to said second end, said first end being pivotally connectable to a clamping jaw;

an abutment having a substantially vertically aligned inclination for receiving said second end of said lever with said lever being guidable and displaceable in said substantially vertically aligned inclination of said abutment; and, a base plate having at least two diametrically opposed clamping jaws disposed on a substantially horizontal plane for receiving the rod, at least one clamping jaw of said at least two diametrically opposed clamping jaws being radially displaceable by said lever in an outwardly direction for countering the biassing force of said spring for opening and setting free the rod, said clamping jaw being radially displaceable is pivotally connected to said first end of said lever, with said second end of said lever being guidable and displaceable in said substantially vertically aligned inclination of said abutment in a substantially vertical manner and located above a horizontal plane defined by a direction of movement of said clamping jaw which is radially displaceable.

2. The stand for vertically receiving rod-shaped materials according to claim 1, wherein said abutment is diametrically opposed to said clamping jaw which is radially, displaceable.

3. The stand for vertically receiving rod-shaped materials according to claim 1, wherein said lever is a frame circumscribing reception of the rod.

4. The stand for vertically receiving rod-shaped materials according to claim 1, further comprising a swivelling axis with a cross brace with said lever being guided on both sides in a region of said swivelling axis via said cross brace with the direction of movement of said clamping jaw, which is radially displaceable, being in a guiding groove in said base plate.

5. The stand for vertically receiving rod-shaped materials according to claim 1, wherein the end of said lever rests against said inclination via a roller.

6. The stand for vertically receiving rod-shaped materials according to claim 1, further comprising a tread surface affixed to said lever proximate said abutment.

7. The stand for vertically receiving rod-shaped materials according to claim 6, further comprising two of said tread surfaces symmetrically disposed relative to said abutment.

8. The stand for vertically receiving rod-shaped materials according to claim 1, wherein said diametrically opposed clamping jaws have an inner surface shaped to complement the rod to be inserted therein.

9. The stand for vertically receiving rod-shaped materials according to claim 8, wherein said diametrically opposed clamping jaws are shaped as rhombus, when said diametrically opposed clamping jaws are closed.

* * * * *